US012017821B2

(12) United States Patent
Druitt

(10) Patent No.: US 12,017,821 B2
(45) Date of Patent: Jun. 25, 2024

(54) CLOSURE

(71) Applicant: Creanova Universal Closures Limited, Tewkesbury (GB)

(72) Inventor: Rodney Druitt, Tewkesbury (GB)

(73) Assignee: Creanova Universal Closures Limited, Tewkesbury (GB)

( * ) Notice: Subject to any disclaimer, the term of this patent is extended or adjusted under 35 U.S.C. 154(b) by 0 days.

(21) Appl. No.: 17/596,325

(22) PCT Filed: May 29, 2020

(86) PCT No.: PCT/EP2020/065027

§ 371 (c)(1),
(2) Date: Dec. 7, 2021

(87) PCT Pub. No.: WO2020/245050

PCT Pub. Date: Dec. 10, 2020

(65) Prior Publication Data

US 2022/0234789 A1 Jul. 28, 2022

(30) Foreign Application Priority Data

Jun. 7, 2019 (CH) ..... 00776/19

(51) Int. Cl.
*B65D 41/04* (2006.01)
*B65D 41/34* (2006.01)
*B65D 53/00* (2006.01)

(52) U.S. Cl.
CPC ..... *B65D 41/0428* (2013.01); *B65D 41/04* (2013.01); *Y10S 215/01* (2013.01)

(58) Field of Classification Search
CPC ..... B65D 41/0428; B65D 41/045; B65D 41/0421; B65D 41/34; B65D 41/02;
(Continued)

(56) References Cited

U.S. PATENT DOCUMENTS 3,053,406 A * 9/1962 Wandell ..... B65D 41/0428 215/344
3,055,526 A * 9/1962 Plunkett ..... B65D 41/0428 215/DIG. 1

(Continued)

FOREIGN PATENT DOCUMENTS

CH 407785 A 2/1966
FR 2410608 A1 6/1979

(Continued)

OTHER PUBLICATIONS

International Search Report and Written Opinion in PCT/EP2020/065027 mailed Sep. 28, 2020.

*Primary Examiner* — Gideon R Weinerth
(74) *Attorney, Agent, or Firm* — MASCHOFF BRENNAN; Paul G. Johnson

(57) ABSTRACT

The intention relates to a closure (1) for sealing of a neck finish (2) of a liquid container comprising a top deck (3) and an outer skirt (4) extending from the top deck (3) in an axial direction (z) away from the top deck (3) comprising at least one locking means (5) for engaging the closure (1) to the neck finish (2) of the liquid container. A with respect to the top deck (2) deformable primary sealing lip (6) is arranged on an inner surface (7) of the top deck (3) and extends in a circumferential manner along the inner surface (7) of the top deck (3). The primary sealing lip (6) comprises with respect to its cross-section a dorsal end (8) connected to the inner surface (7) of the top deck (3) and a free distal end (9) arranged opposite to the dorsal end (8), wherein the primary sealing lip (6) with respect to its cross section is arranged in an inclined manner facing inwardly. Furthermore, at least one supporting element (10) protrudes from the inner surface (7) of the top deck (3), said supporting element (10) being arranged coaxially to and at least partially in side of the primary sealing lip (6). The at least one supporting
(Continued)

element (10) is configured to support the primary sealing lip (6) with respect to the neck finish (2) in an applied position of the closure (1).

7 Claims, 4 Drawing Sheets

(58) Field of Classification Search
CPC .. B65D 41/04; B65D 41/0407; B65D 41/005; B65D 41/0414; Y10S 215/01
USPC ..... 215/235, DIG. 1, 341, 343, 344, 345
See application file for complete search history.

(56) References Cited

U.S. PATENT DOCUMENTS 3,151,757 A * 10/1964 101964 ..... B65D 41/0428 215/DIG. 1
3,203,571 A * 8/1965 Plunkett ..... B65D 41/0428 215/354
3,286,866 A * 11/1966 Mcintosh ..... B65D 41/0428 215/DIG. 1
3,393,818 A * 7/1968 Mcintosh ..... B65D 51/1661 215/344
3,568,871 A * 3/1971 Livingstone ..... B65D 41/185 215/354
3,802,590 A * 4/1974 Culver ..... B65D 41/0428 215/DIG. 1
3,814,274 A * 6/1974 McIntosh ..... B65D 41/0428 215/344
3,815,771 A * 6/1974 Marks ..... B65D 41/0428 215/344
3,948,405 A * 4/1976 Yonker ..... B65D 41/0428 215/DIG. 1
4,061,240 A * 12/1977 Brownbill ..... B65D 41/0428 215/DIG. 1
4,069,937 A * 1/1978 Smalley ..... B65D 41/0428 215/DIG. 1
4,196,818 A * 4/1980 Brownbill ..... B65D 41/3428 215/DIG. 1
4,220,250 A * 9/1980 Brownbill ..... B65D 41/0428 215/DIG. 1
4,276,989 A * 7/1981 Hicks ..... B65D 41/0428 215/DIG. 1
4,360,114 A * 11/1982 Owens ..... B65D 41/0428 215/DIG. 1
4,429,802 A * 2/1984 Marks ..... B65D 41/0428 215/DIG. 1
4,450,973 A * 5/1984 Toeppen ..... B65D 41/0428 215/DIG. 1
4,526,284 A * 7/1985 Herbert ..... B65D 41/04 215/DIG. 1
4,540,102 A * 9/1985 Wiedmer ..... B65D 41/0421 215/DIG. 1
4,598,835 A * 7/1986 Brownbill ..... B65D 41/0428 215/DIG. 1
4,623,070 A * 11/1986 Nishikawa ..... B65D 41/0428 215/DIG. 1
4,673,096 A * 6/1987 Towns ..... B65D 79/0087 215/230
4,850,497 A * 7/1989 Kessler ..... B65D 41/0428 215/DIG. 1
5,320,236 A * 6/1994 Gregory ..... B65D 41/0428 215/DIG. 1
5,423,444 A * 6/1995 Druitt ..... B65D 41/0428 215/DIG. 1
5,609,263 A * 3/1997 Perchepied ..... B65D 41/3447 215/DIG. 1
5,638,972 A * 6/1997 Druitt ..... B65D 41/3447 215/DIG. 1
5,667,089 A * 9/1997 Moore ..... B65D 41/045 215/DIG. 1
5,782,369 A * 7/1998 Tansey ..... B65D 41/0428 215/331
6,382,445 B1 * 5/2002 McCandless ..... B65D 41/0428 215/DIG. 1
6,527,132 B1 * 3/2003 Druitt ..... B65D 41/0428 215/DIG. 1
6,544,609 B1 * 4/2003 Goldman ..... B29C 48/12 523/210
6,772,894 B1 * 8/2004 Druitt ..... B65D 41/3447 215/DIG. 1
7,850,029 B2 * 12/2010 Dreyer ..... B65D 41/0421 215/44
2004/0238478 A1 * 12/2004 Druitt ..... B65D 41/3447 215/344
2006/0163192 A1 * 7/2006 Price ..... B65D 41/0428 215/258
2022/0234789 A1 * 7/2022 Druitt ..... B65D 41/0428

FOREIGN PATENT DOCUMENTS

GB 1499895 A 2/1978
GB 2120219 A 11/1983
GB 2432153 A 5/2007
WO WO-9734812 A1 * 9/1997 ..... B65D 41/0428

* cited by examiner

CLOSURE

FIELD OF THE INVENTION

The present invention relates to a closure, especially a closure for containers for liquids. In particular, the invention relates to a closure for neck finishes of blow molded containers.

BACKGROUND OF THE INVENTION

Containers for large volumes of liquids such as e.g. containers for washing agents or milk bottle are often blow molded plastic containers. A disadvantage of these blow molded containers are geometric inaccuracies and seams at the opening of the container which complicate the positioning of the closure on the neck finish and hence the reliable sealing of the individual container opening.

It is an object of the invention to provide a closure with an improved sealing which compensates geometric inaccuracies of the neck finish of the liquid container.

SUMMARY OF THE INVENTION

The invention relates to a closure for sealing a neck finish of a liquid container. The closure comprises a top deck and an outer skirt extending from the top deck in an axial direction away from the top deck comprising at least one locking means (respectively locking structure) for engaging the closure to the neck finish of the liquid container. The locking means can be a thread arranged on the outer skirt or a snap lock to snap the closure on the neck finish. Other locking means are also possible. Depending on the application, the closure may further comprise a hinge.

A deformable primary sealing lip is arranged on an inner surface of the top deck and extends, respectively protrudes, in a circumferential manner along the inner surface of the top deck. The primary sealing lip is preferably deformable with respect to the top deck. With respect to its cross-section the primary sealing lip comprises a dorsal end connected to the inner surface of the top deck and a free distal end arranged opposite to the dorsal end. Preferably, the primary sealing lip has in the cross-section an elongated shape extending from the dorsal end towards the distal end featuring a first and a second side (opposite of the first side) in between the dorsal end and distal end. Furthermore, the primary sealing lip is arranged with respect to its cross section in an inclined manner facing inwardly (in the radial direction towards a center axis of the closure; the center axis extending in the axial direction, perpendicular to the radial direction). Hereby, the second side of the primary sealing lip is facing the inner surface of the top deck.

Preferably, the primary sealing lip features in an undeformed position (before initially applying the closure on the neck finish) a larger inclination angle than in a deformed position (after initially applying the closure on the neck finish). The inclination angle is thereby defined between the primary sealing lip and the inner surface of the top deck facing radially inwards (towards the center axis). Depending on the application, the first and/or the second side of the primary sealing lip may be essentially straight in the undeformed position, e.g. the primary sealing lip may have a rectangular cross-section in the undeformed position. Hence, the inclination angle is essentially uniform over the primary sealing lip. However, also curved embodiments of the first and/or second sides are possible in the undeformed position. For injection molded plastic closures a curved design is possible, as long as it is demoldable. In the case of a curved sealing lip, the inclination angle can be understood as an average angle. The primary sealing lip may be at least partially plastically deformable, such that a deformed position of the primary sealing lip is maintained after initially applying the closure to the neck finish. An inclination angle of the primary sealing lip in the undeformed position can be i.g. in the range of $\alpha$=30-60 deg (degree). The (average) inclination angle of the primary sealing lip in the deformed position and in the applied position of the closure on the neck finish may be in the range of $\alpha$=10-50 deg, however other angles are also possible. To facilitate the deformation of the primary sealing lip, the primary sealing lip may further comprise a thinning at the dorsal end with respect to the cross-section of the primary sealing lip, close to the inner surface of the top deck.

Preferably, at least one supporting element protrudes from the inner surface of the top deck, configured to support the primary sealing lip with respect to the neck finish in an applied position of the closure. The supporting element is arranged coaxially to the primary sealing lip to provide a uniform sealing over the circumference. Furthermore, the supporting element may be arranged on the inner surface of the top deck at least partially inside of the primary sealing lip. Preferably, the supporting element is in a radial direction arranged closer to the center axis of the closure than the primary sealing lip. Depending on the application, the supporting element may also be deformable. In an applied position of the closure, the at least one supporting element, is advantageously at least partially arranged within a projection area of the deformed primary sealing lip in the axial direction and on the inner surface. In that way, the supporting element is connected to the inner surface of the top deck in the radial direction between the distal end and the dorsal end of the deformed primary sealing lip in an applied position of the closure.

When the closure is applied for the first time, the primary sealing lip preferably engages first with the distal end with a rim of the neck finish. If the closure is applied further (e.g. the closure may be screwed further down on the neck finish) the primary sealing lip begins to deform and establishes a surface contact along the first side of the primary sealing lip. As the application pressure of the closure increases the primary sealing lip further bends radially inwards and engages with the supporting element on its second side. When the closure is fully applied, the primary sealing lip has preferably a surface contact at least partially along the first side of the primary sealing lip and is in contact with the inner edge of the rim of the neck finish. On the second side, the primary sealing lip is in contact with the at least one supporting element. The supporting element thereby supports the contact of the primary sealing lip against the rim by increasing the pressure on the inner edge of the rim. The overall sealing of the closure against the neck finish is thus enhanced. In the applied position of the closure a chamber may be formed between the primary sealing lip and the at least one supporting element. Enclosed air in the chamber thereby increases the sealing quality since it contributes to the deformability of the primary sealing lip around the rim of the neck finish.

Depending on the application, the at least one supporting element may be a secondary sealing lip, which is also inclined radially inwards, facing away from the outer skirt, as described for the primary sealing lip. Respectively, the secondary sealing lip may also be deformable. For good sealing qualities the outer rim of the neck finish in the axial direction can be arranged in the radial position between the dorsal end of the primary sealing lip and a distal end of the secondary sealing lip with respect to a cross section of the (primary and secondary) sealing lips in the undeformed position before initially applying the closure.

In another variation of the closure according to the invention, the at least one supporting element may be a circumferential first bump. Furthermore, the closure may comprise a circumferential second bump as a second supporting element arranged radially inwards of the circumferential first bump which extends along the primary sealing lip. For a uniform sealing along the circumference of the neck finish, the circumferential first bump is preferably arranged coaxially to the circumferential second bump. Good results can be achieved, if the circumferential second bump has a larger height in axial direction and in respect to the inner surface of the top deck than the circumferential first bump. Preferably, the circumferential first and second bump are arranged at least partially within the projection area of the inclined and deformed primary sealing lip on the inner surface in an applied position of the closure. In that case, the circumferential first and the second bump each connected via a base to the inner surface of the top deck, are arranged with their bases at least partially between the distal end and the dorsal end of the deformed primary sealing lip in an applied position of the closure.

The primary sealing lip and the at least one supporting element may be formed as an integral part of the closure or can be interconnected to the top deck as a separate element. Preferably, the closure is made by a (first) plastic material, in particular an injection molded plastic material. Thereby, the primary sealing lip and/or the supporting element may be made at least partially of a second plastic material, which is softer than the (first) plastic material of the other closure parts. The first and the second plastic material may injection molded in a two material injection molding process.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described invention will be more fully understood from the detailed description given herein below and the accompanying drawings which should not be considered limiting to the invention described in the appended claims. The drawings are showing:

DESCRIPTION OF THE EMBODIMENTS

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
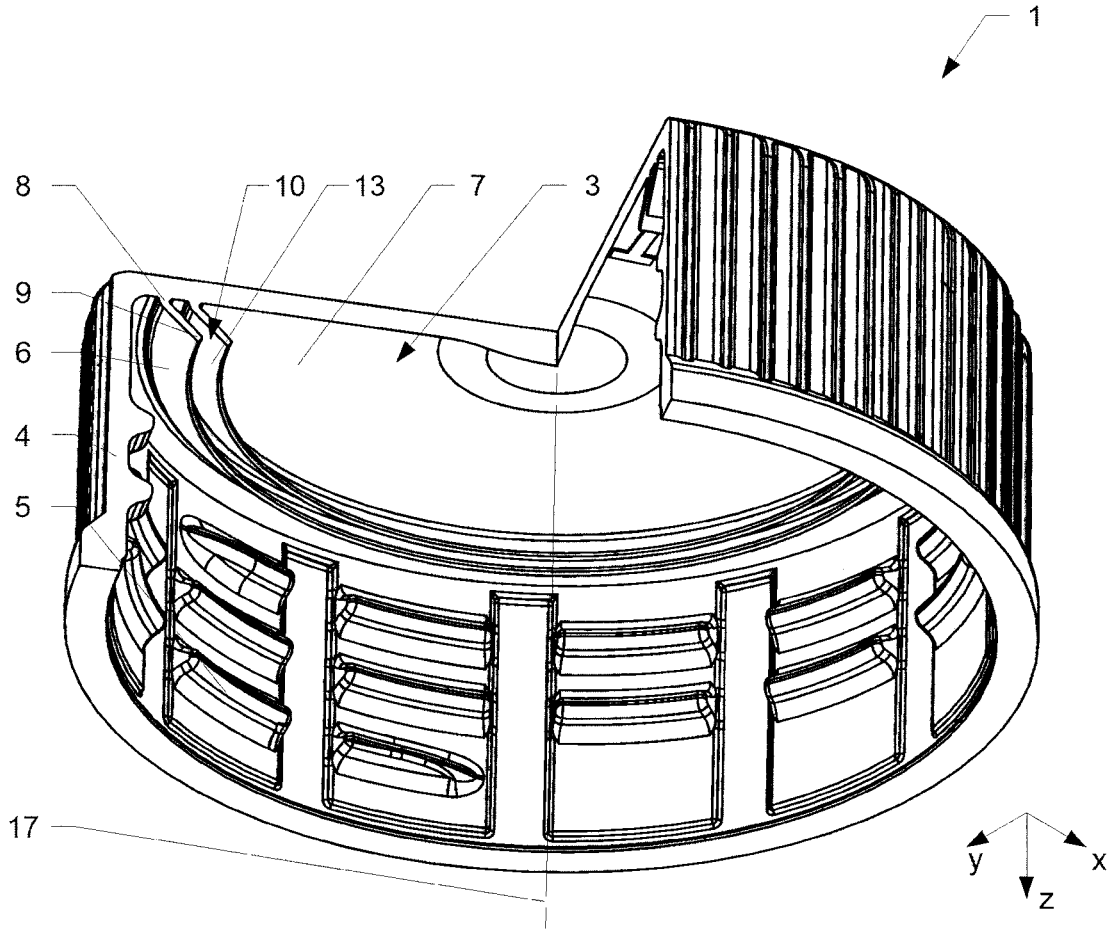
FIG. 1 A closure according to a first variation of the invention in a perspective partly sectionized view.
Figure 2:
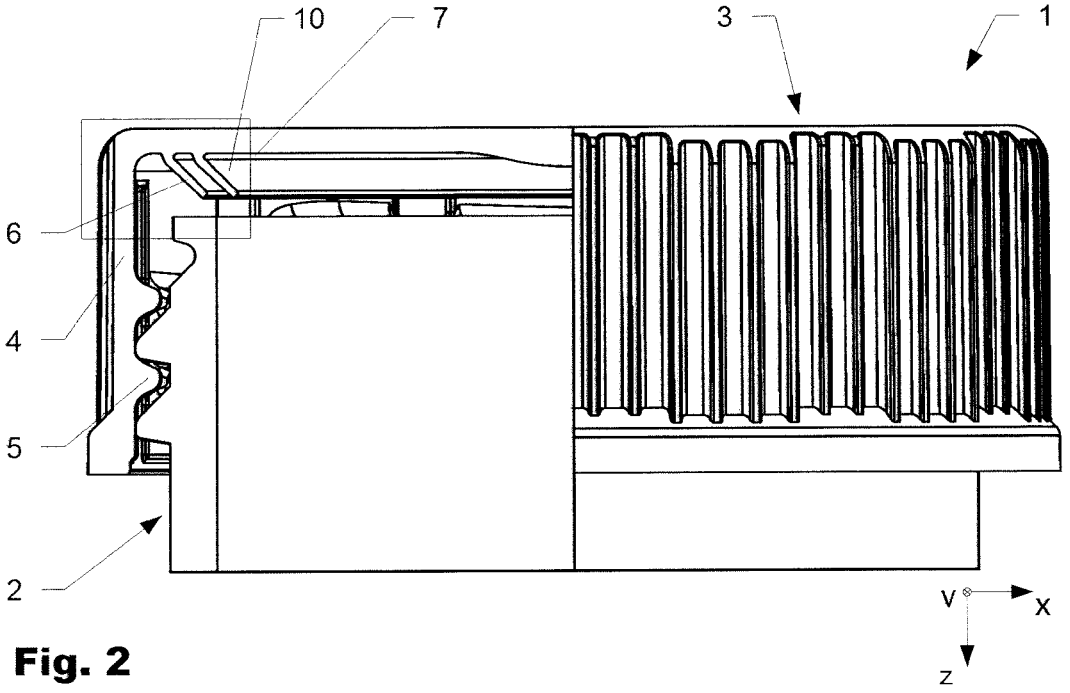
FIG. 2 The closure according to FIG. 1 in a front view.
Figure 3:
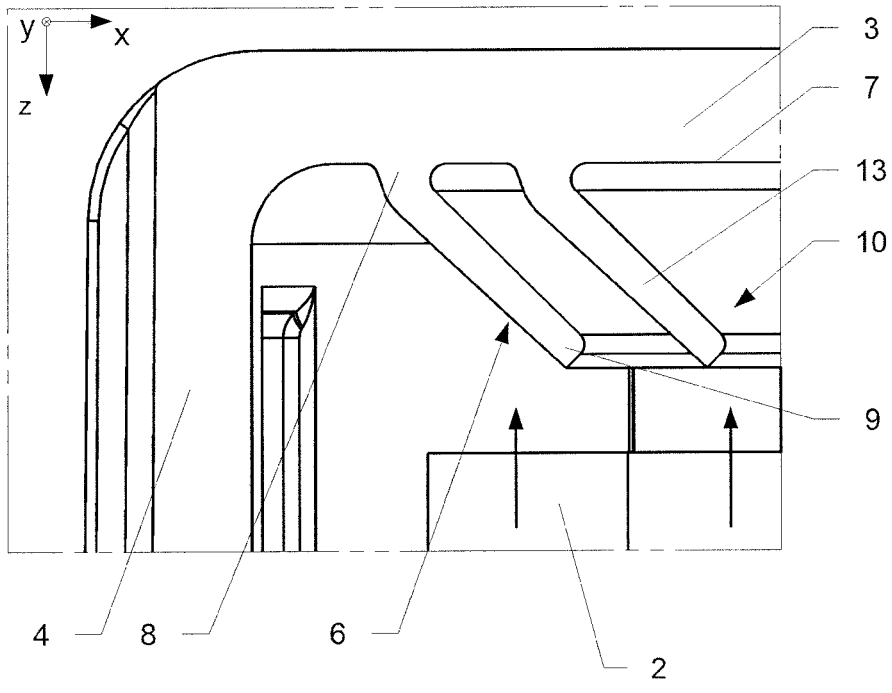
FIG. 3 A detail of FIG. 2 of a primary and secondary sealing lip.

FIG. 1 and FIG. 2 show a closure according to a first variation of the invention in a partly sectionized view. FIG. 1 is a perspective view; FIG. 2 is a front view. The closure 1 comprises a top deck 3 and an outer skirt 4 extending from the top deck 3 in an axial direction z away from the top deck 3. The closure 1 as depicted, is a screw cap, with a thread as a locking means 5. Alternatively, the closure could also feature other locking means to interconnect and engage the closure 1 to a neck finish of a liquid container (not shown). A with respect to the top deck 3 a deformable primary sealing lip 6 is arranged on an inner surface 7 of the top deck 3 and protrudes in a circumferential manner along the inner surface 7 of the top deck 3. In a cross section, as it can be seen in FIG. 2 and FIG. 3, the primary sealing lip 6 comprises a dorsal end 8 connected to the inner surface 7 of the top deck 3 and a free distal end 9 arranged opposite to the dorsal end 8. The primary sealing lip 6 is arranged with respect to its cross section in an inclined manner facing radially inwards towards a center axis 17 and away from the outer skirt 4. Next to the primary sealing lip 6, a supporting element 10, in form of a secondary sealing lip 13, is protruding from the inner surface 7 of the top deck. In the shown variation, the secondary sealing lip 13 has essentially the same shape and geometry as the primary sealing lip 6. However, other embodiments are possible. The secondary sealing lip 13 is arranged coaxially to and at least partially inside of the primary sealing lip 6. The secondary sealing lip 13 is configured to support the primary sealing lip 6 with respect to the neck finish 2 in an applied position of the closure 1.

Figure 4:
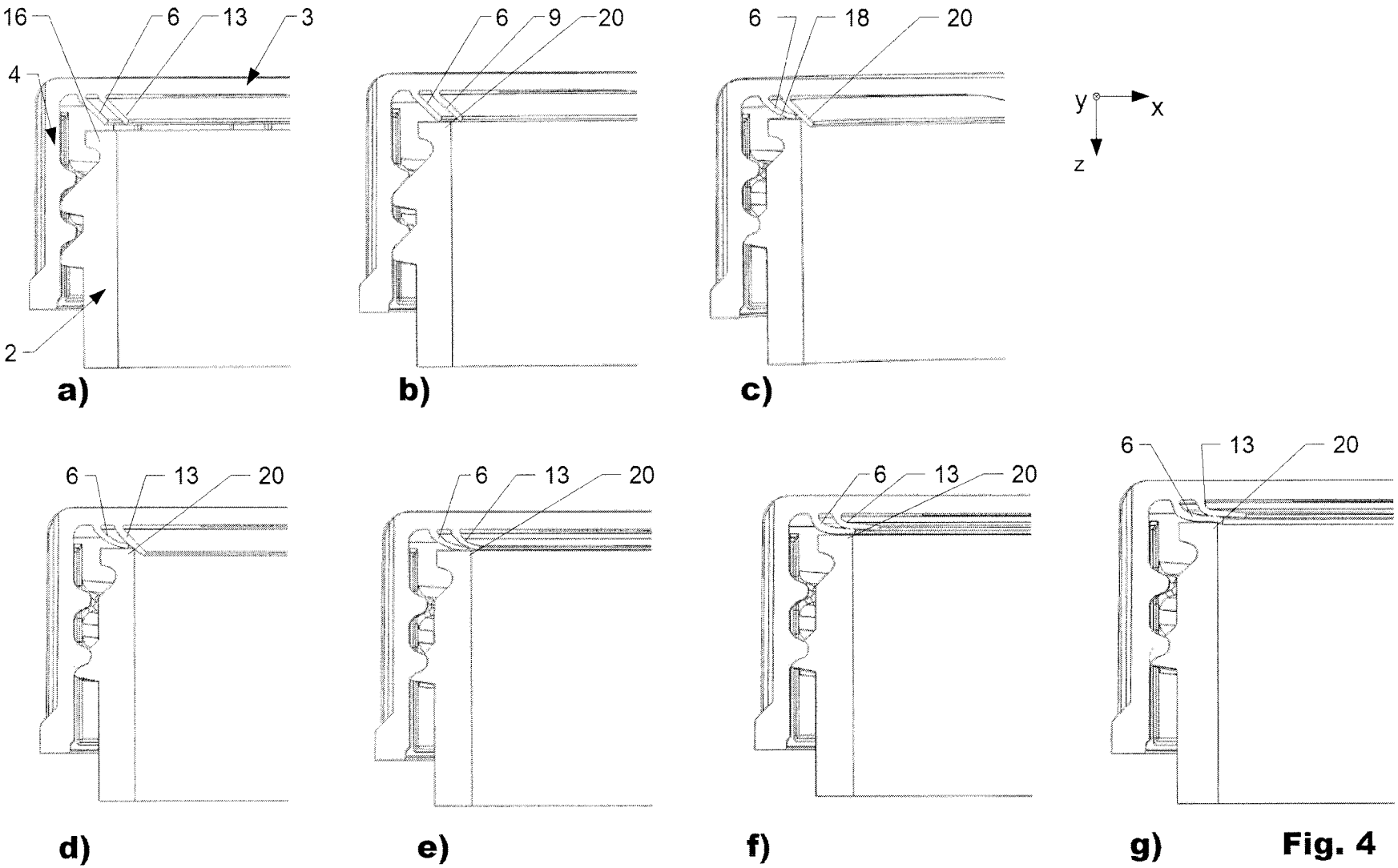
FIG. 4 The process of applying the closure according to FIG. 1 to a neck finish.
Figure 5:
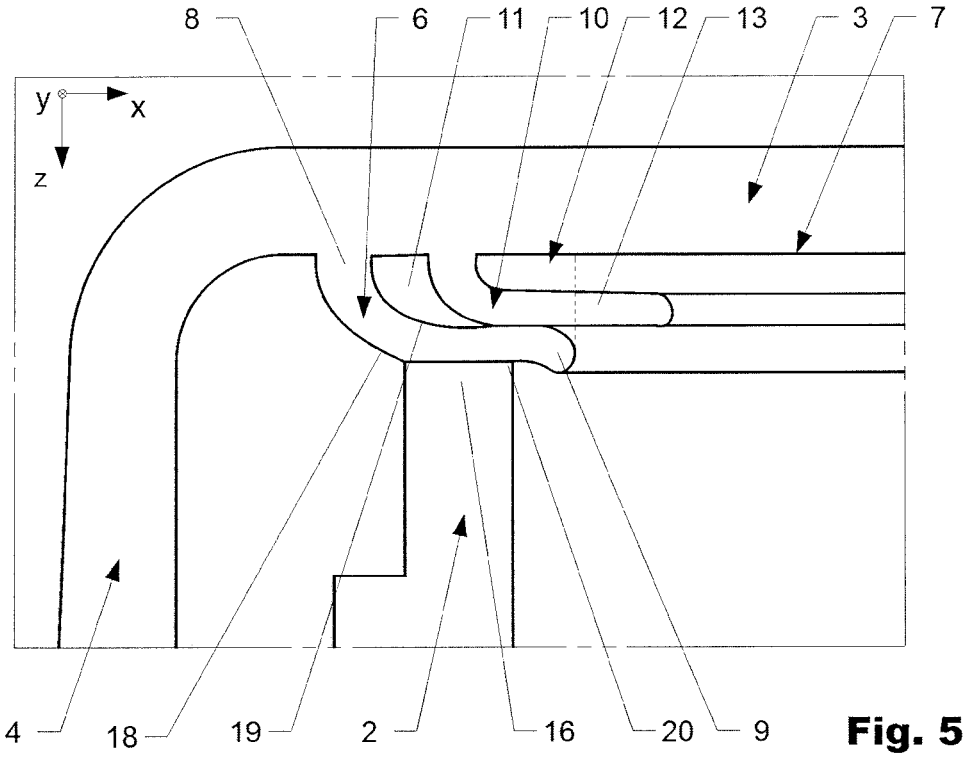
FIG. 5 The schematic drawing of the primary and secondary sealing lip in a deformed and applied position.

If the closure 1 is applied for the first time on a neck finish 2 of the liquid container, the primary and the secondary sealing lip 6, 13 are deformed. Preferably, the primary and the secondary sealing lip 6, 13 are at least partially plastically deformed, such that a deformed position at least of the primary sealing lip 6 is maintained after initially applying the closure 1 to the neck finish 2. FIG. 4 *a*)-*g*) show the process of applying the closure 1 according to the first variation of the invention to a neck finish 2. FIG. 4*a*) illustrates the neck finish 2 not yet applied and the primary and secondary sealing lip 6, 13 in an undeformed position. In FIG. 4*b*) a rim 16 of the neck finish 2 comes in contact with the distal end 9 of the primary sealing lip 6. If the closure 1 is applied further, as illustrated in FIG. 4*c*) the primary sealing lip 6 starts to bend and to deform under the pressure of the neck finish 2. At this stage of applying the closure to the neck the primary sealing lip 6 has on a first side 18 a surface contact with the rim 16 of the neck finish 2. Furthermore, due to the bending of the primary sealing lip 6 a chamber 11 is formed between the primary and the secondary sealing lip 6, 13. Furthermore, the secondary sealing lip 13 may also come briefly into contact with the rim 16 during the application. In FIG. 4*d*-*g*) it can be seen that the primary sealing lip 6 is pushed inwards over the inner edge 20 of the rim 16 of the neck finish 2 in the radial direction. The secondary sealing lip 13, now in contact with a second side 19 of the primary sealing lip 6, is further bent and supports the primary sealing lip 6 to enhance the sealing quality. Due to the deformation of the primary and/or the secondary sealing lip 6, 13 the chamber 11 may change its geometry in the process and building up a pressure inside the chamber 11 when being reduced in volume. The enclosed air in the chamber 11 thus further supports the sealing. FIG. 5 illustrates the detail of closure 1 according to FIG. 3 in a fully applied position of the closure 1 on the neck finish 2. In the applied position of the closure the secondary sealing lip 13, is at least partially arranged within a projection area 12 of the inclined primary sealing lip 6 in the axial direction and on the inner surface 1 (projection is indicated by dashed line).

Figure 6:
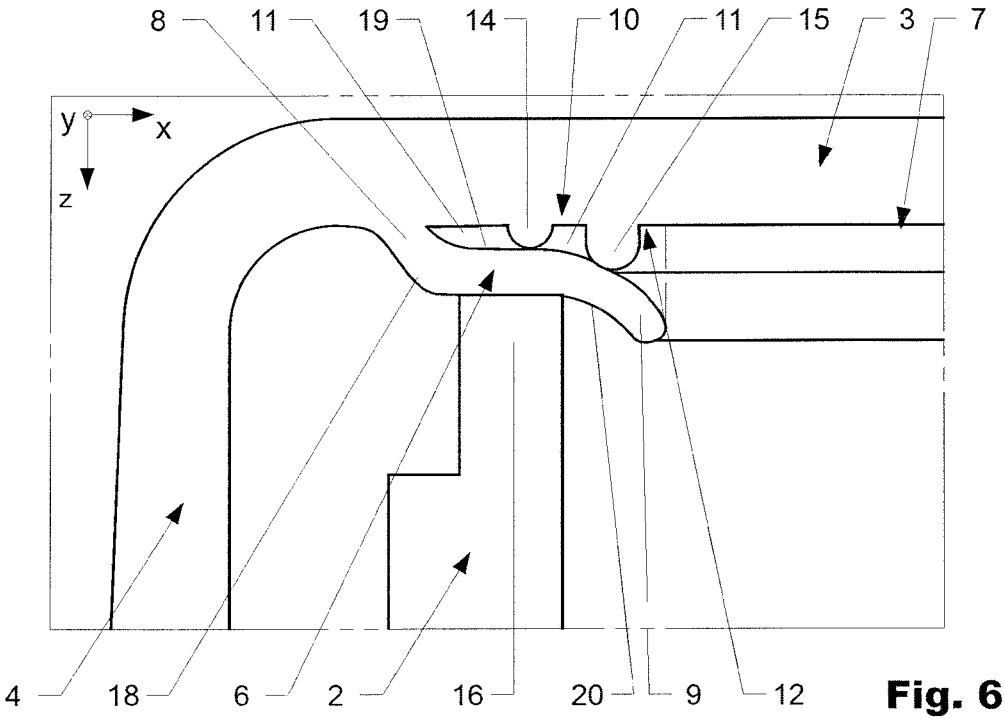
FIG. 6 The schematic drawing of a second variation of the closure with the primary sealing lip in a deformed position.

FIG. 6 shows a schematic drawing of a second variation of the closure 1 in a deformed position of the primary sealing lip 6. The closure (even though not shown in full) may be designed according to the closure 1 of the first variation with a top deck 3 and an outer skirt 4 having a thread as a locking means 5, however, the second variation of the sealing means, respectively the primary sealing lip 6 and the at least one supporting element 10, may also be used on other closure geometries, such as hinged closures and/or closures with a snap lock as a locking means.

In the illustrated second variation, the primary sealing lip 6 is combined with two supporting elements 10: A circumferential first and second bump 14, 15. The circumferential first and second bump 14, 15 are arranged on the inner surface 7 of the top deck 3, extending from said top deck 3. Furthermore, the primary sealing lip 6 and the circumferential first and second bump 14, 15 are arranged coaxially with respect to each other. In particular, the circumferential first and second bump 14, 15 are preferably arranged at least partially within the projection area 12 of the inclined primary sealing lip 6 on the inner surface 7 in an applied position of the closure 1 (projection is indicated by dashed line). As it can be seen, the first and the circumferential second bump 14, 15 may have different heights (in the axial direction) in respect to the inner surface 7 of the top deck 3. Good sealing results may be achieved, if the circumferential second bump 15 arranged radially inwards of the circumferential first bump 14 extends in axial direction further away from the inner surface 7 than the circumferential first bump 14.

The words used in the specification are words of description rather than limitation, and it is understood that various changes may be made without departing from the spirit and scope of the invention.

| LIST OF DESIGNATIONS | |
|---|---|
| 1 | Closure |
| 2 | Neck finish |
| 3 | Top deck |
| 4 | Outer skirt |
| 5 | Locking means |
| 6 | Primary sealing lip |
| 7 | Inner surface |
| 8 | Dorsal end |
| 9 | Distal end |
| 10 | Supporting element |
| 11 | Chamber (Supporting element) |
| 12 | Projection area |
| 13 | Secondary sealing lip |
| 14 | (First) Bump |
| 15 | (Second) Bump |
| 16 | Rim |
| 17 | Center axis |

-continued

| LIST OF DESIGNATIONS | |
|---|---|
| 18 | First side |
| 19 | Second side |
| 20 | Inner edge (rim) |

The invention claimed is:

1. A closure, for sealing of a neck finish of a liquid container, comprising a top deck and an outer skirt extending from the top deck in an axial direction (z) away from the top deck, said outer skirt comprising at least one locking means for engaging with the neck finish of the liquid container;

a circumferential deformable primary sealing lip depending from an inner surface of the top deck and spaced radially inwardly from the outer skirt, said primary sealing lip comprising a dorsal end connected to the inner surface of the top deck and a free distal end arranged opposite to the dorsal end, the primary sealing lip being inclined radially towards a center of the closure; and a circumferential first support element and a circumferential second support element, wherein both the first support element and the second support element have semi-circular cross-sections and are positioned on the inner surface of the top deck;

wherein the first support element is spaced radially inwardly of the primary sealing lip and the second support element is spaced radially inwardly of the first support element;

wherein the second support element has a larger height in the axial direction than the first support element;

wherein when the closure is applied to the neck finish of the container, the primary sealing lip comes into contact with a rim of the neck finish of the liquid container and thereby forms:

a first chamber, defined by the primary sealing lip, the first support element, and the inner surface of the top deck, and a second chamber defined by the primary sealing lip, the first support element, the second support element, and the inner surface of the top deck.

2. The closure according to claim 1, wherein the primary sealing lip in an undeformed position is inclined radially inwards by an inclination angle a=30-60 deg in respect to the inner surface of the top deck.

3. The closure according to claim 1, wherein the primary sealing lip has a thinning at the dorsal end of the primary sealing lip to facilitate deformation.

4. The closure according to claim 1, wherein the primary sealing lip and the supporting element or elements are formed as an integral part of the closure.

5. The closure according to claim 1, wherein the outer skirt and the top deck are made of a first plastic material and the primary sealing lip and/or the supporting element or elements are made at least partially of a second plastic material, which is more deformable than the first plastic material.

6. The closure according to claim 1, wherein the locking means is a thread arranged on the outer skirt.

7. The closure according to claim 1, wherein the first side of the primary sealing lip is in surface contact with substantially the entire rim of the neck finish in the applied position of the closure.

* * * * *